United States Patent [19]

McDermott

[11] 4,048,737

[45] Sept. 20, 1977

[54] DUAL IDENTIFICATION CARD AND IDENTIFICATION CARD HOLDER

[76] Inventor: Clifton Eugene McDermott, 1778 Oakridge Drive, Salt Lake City, Utah 84106

[21] Appl. No.: 549,163

[22] Filed: Feb. 12, 1975

[51] Int. Cl.[2] ..... G09F 11/02

[52] U.S. Cl. ..... 40/2.2

[58] Field of Search ..... 40/2.2, 10 R, 16, 17; 402/3; 101/369

[56] References Cited

U.S. PATENT DOCUMENTS

| | | | |
|---|---|---|---|
| 2,175,260 | 10/1939 | Gollwitzer | 101/369 |
| 2,222,535 | 11/1940 | Henry, Jr. | 40/20 R |
| 2,363,096 | 11/1944 | Sullivan | 101/369 |
| 2,951,301 | 9/1960 | Slavsky | 40/17 |
| 3,593,443 | 7/1971 | Demetrius, Jr. et al. | 40/2 R |
| 3,751,835 | 8/1973 | Smith | 40/21 C |

*Primary Examiner*—G.E. McNeill

*Attorney, Agent, or Firm*—Criddle, Thorpe & Western

[57] ABSTRACT

A duel identification card for use in hospitals and the like and from which the data contained thereon may be transferred to charts, cards and the like. The upper card section contains a transverse slot in one end and, when severed from the lower section, is adapted to be attached to a tether and stored in a patient's wristband. The lower section of the card contains a longitudinal slot near the bottom edge and is adapted to fit into a generally flat rectangular spring steel holder containing protruding lips against which the bottom of the card rests and also contains retention clips in alignment with the protruding lips which clips are configured to secure the card to the holder. The lower card section and holder may be kept at a nurses station or similar place.

7 Claims, 9 Drawing Figures

DUAL IDENTIFICATION CARD AND IDENTIFICATION CARD HOLDER

BRIEF SUMMARY OF THE INVENTION

1. Field of the Invention

This application relates to duel identification cards and the like, and to a holder for containing one section of a duel identification card. More specifically this invention relates to duel identification cards for use in hospitals or other places wherein it is desirable to make more than one identification card containing the same or similar information, the cards being of different sizes and to a holder for containing one portion of the duel card.

2. Prior Art

In the operation of hospitals, rest homes and other facilities, it is often necessary or desirable to store information relating to a patient on one or more plastic encoded cards from which the information can be readily retrieved and transferred to charts, papers, cards, labels and the like by mechanical means. Usually one card is kept at the nurses station and is used each day to make charts on which are recorded vital signs, food and liquid intake, and the like. In U.S. Pat. No. 3,656,247, a smaller tag is disclosed which is attached to and stored in the patient's wristband and from which the information contained thereon can be reproduced onto pressure sensitive labels.

SUMMARY OF THE INVENTION

It is an object of the present invention to provide a duel identification card which can be encoded with the desired information and then divided into separate identification sections.

It is also an object of the present invention to provide a duel identification card which may be encoded with the desired information and then separated into an identification card for use at a nurses station or similar place, and an identification card adapted to fit into a patient's wristband.

It is a further object of the present invention to provide a novel holder for the identification card at the nurses station.

Principal features of this invention include a duel identification card which may be separated into two identification sections. The card is generally rectangular in shape and has identically spaced indentations on either side thereof with a score line running from one indentation to the other. The card section above the score line is further divided by a notch which is normal to the score line and offset from the center of the card. The notch is of any desired configuration and runs from the top of the card to the score line. Preferably the notch is wider at the top than at the bottom. Of the two portions of the card above the score line the larger one is generally rectangular in shape and contains a transverse slot in one end thereof. This portion of the card is referred to as the "patient's" card or section. The smaller section above the score line is generally in the form of an irregular quadrangle and is referred to as the "tab" section. The lower portion of the card contains a longitudinal slot centrally located in the lower portion thereof and is adapted to fit into a holder to be kept at a central location such as a nurses station, and is referred to as the "nurses" card or section.

The card is made of plastic, metal or other material which can be embossed or otherwise coded with raised letters, numbers or other indicia. Since the card is unitary in structure, all portions of the card can be embossed in one operation. The "patient's" and "nurses" sections of the card will normally contain similar data such as the patient's name, doctor's name, and the like. The "tab" section will contain such data, i.e., name, room number, etc., to allow rapid identification of the card.

The "patient's" section is severed from the card by bending along the score line and is attached to a patient's identification wristband by a tether inserted through the transverse slot contained therein.

The "tab" and "nurses" section may be used together and stored in a card file or similar place. The tab serves to quickly identify the "nurses" section of the card and the material contained thereon. Preferably the "nurses" section of the card will be contained by a holder and the "tab" section removed. The holder is made of spring steel and has a generally rectangular shape. The length of the holder is the same as the length of the "nurses" card section. A tab extends from the top edge of the holder to which an embossed tape having approximately the same thickness as the "nurses" card section may be adhesively attached.

Centrally located in the lower portion of the holder is a retention clip which is an integral part of the holder but has freedom of movement around the sides and top thereof. The lower portion of the clip is in the same plane as the holder. Holding means, fashioned from the clip, consist of the upper portion of the clip which extends outwardly a distance equal to the thickness of the "nurses" card section upwardly for a distance equal to the space between the bottom edge of the "nurses" card section and the longitudinal slot contained therein, and then inwardly to be aligned with the back of the holder. Outwardly protruding lips which serve as card stops from a line extending outwardly from the sides of the clip are optionally included.

Spaced inwardly from the outside edges of the holder and adjacent to the outside edge of the protruding lips, when said lips are included, are two additional retention clips which also serve as card stops and to secure the card to the holder. These clips are in the same plane as and are identical in features with the central retention clip with the exception that instead of the holding means turning inwardly aat the top portion thereof they terminate with the upward extension.

The "nurses" card section is inserted in the holder by rotating the center retention clip outwardly and placing the card section under the clip with the bottom edge of the card resting on the outward extensions of the outside retention clips and on the outwardly protruding lips if included in the holder. Upon return of the center clip to its normal position the card is clamped to the holder by the clip, firmly engaging the card between the bottom edge and the longitudinal slot. The bottom edge of the card rests on the outward extensions of the three clips and the optionally outwardly protruding lips. The inward extension of the central clip passes through the longitudinal slot in the card. The card and holder are sized such that when engaged in the holder, the tops of the holder and "nurses" card section are substantially the same.

These and other objects and features will become apparent from the following description of the invention, the accompanying drawings and the claims.

THE DRAWINGS

In the drawings:

FIG. 1 is a top plan view of a duel identification card of the invention;

FIG. 2, a top plan view of an identification section which comprises a part of the upper portion of the duel identification card as shown in FIG. 1;

FIG. 3, a top plan view of a second identification section, with tab, which comprises the remainder of the duel identification card shown in FIG. 1 but not shown in FIG. 2;

FIG. 4, a top plan view of the identification section shown in FIG. 3, with the tab detached;

FIG. 5, a top plan view of an identification card holder;

FIG. 6, an enlarged, fragmentary, vertical sectional view, taken along line 6—6 of FIG. 5;

FIG. 7, an enlarged, fragmentary, vertical sectional view, taken along lines 7—7 of FIG. 5;

FIG. 8, an enlarged, fragmentary, vertical sectional view, taken along lines 8—8 of FIG. 5; and FIG. 9, a perspective view of the card holder shown in FIG. 5, containing the identification card as shown in FIG. 4.

DETAILED DESCRIPTION

Figure 1:
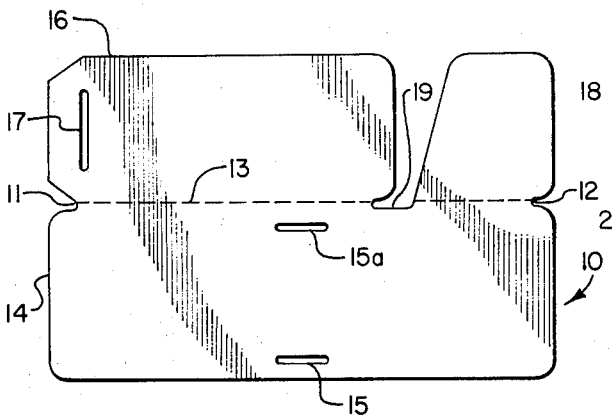

Referring now to the drawings:

The duel identification card of the invention is shown at 10 in FIGS. 1-4. Duel identification card 10 may be made of any suitable material capable of being stamped or embossed so as to contain raised numerals and letters or other symbols which can then be transferred to other materials by means of pressure application. Card 10 may be made by cutting or stamping from sheet material. The card has a generally rectangular shape which may be rounded or beveled at the corners. While card 10 is of unitary construction it is so formed that it may be easily divided into three sections 14, 16 and 18 as will be fully detailed below. Section 14 may be severed from sections 16 and 18 along score line 13 which runs along the plate from indentation 11, through notch 19 to indentation 12. Indentations 11 and 12 are similarly spaced between the top and bottom of card 10 depending upon the space desired for each section 14 and 16. Sections 16 and 18 are separated from each other by notch 19. For identification purposes, similar information will usually be placed on both sections 14 and 16, and will be encoded on both prior to severing along score line 13. When formed in this manner each duel card 10 comprises a unitary identification set and there is no need to resort to separate tags of different sizes on which to encode the desired information.

Figure 2:
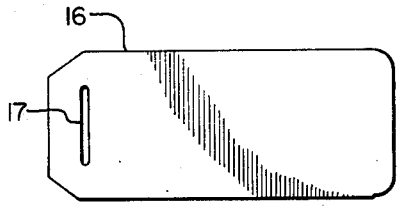

Section 16, also referred to as the "patient's card", is illustrated in FIG. 2 and is generally rectangular in shape. It is severed from duel card 10 along score line 13. One end of section 16 has a transverse slot 17 adapted to receive a tether (not shown) attached to a patient's wristband, as illustrated in U.S. Pat No. 3,656,247.

Figure 3:
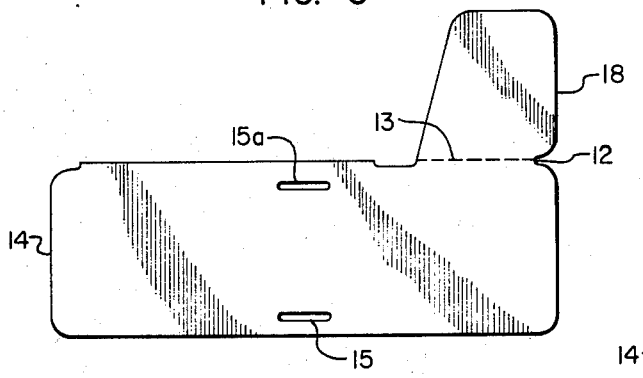

With section 16 detached from duel identification card 10, identification section 14 and tab section 18 of the card remain to assume the general configuration shown in FIG. 3. Section 18 is a tab section which, as illustrated, is in the shape of an irregular quadrangle, but may be in any desired configuration. Any desired data such as patient's name, hospital number, room number, bed number and the like may be placed on tab section 18. When the identification section 14 and attached tab section 18 are stored in a card file, section 18 serves as a practical means for identification of section 14 and for going from one card to another.

Figure 4:
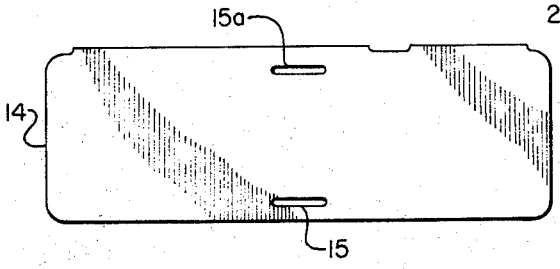

Prferably, however, section 14 will be placed in a holder (as will be more fully defined below) and for that purpose tab section 18 may be severed therefrom along score line 13. Identification section 14 has a centrally located, longitudinal slot 15 in the lower portion thereof. Slot 15 is spaced a predetermined distance from the bottom edge and is sized to fit into a holder having a retention clip adapted to fit into the slot. If desired, an optional slot 15*a* may also be similarly located in the top portion as shown in FIG. 4.

Figure 5:
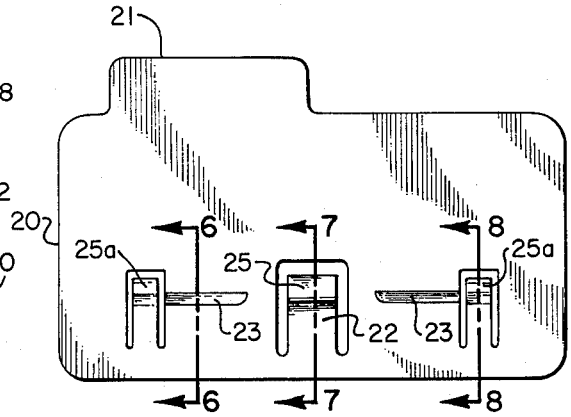
Figures 6, 7, 8:
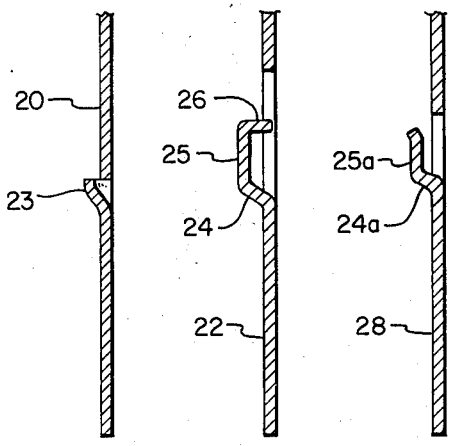

The holder for identification section 14 is shown in FIGS. 5-8. Holder 20 has a generally rectangular shape, but with the corners thereof preferably rounded or beveled and a tab 21 situated on the top portion thereof. Tab 21 may be located at any desired position along a top edge of the holder. Holder 20 is of unitary construction and is preferably made of spring steel. It may be formed by cutting around the outer periphery and around central retention clip 22, outside retention clips 27 and 28 and by making cuts for lips 23 if such lips are to be included. Retention clips 22, 27 and 28 and lips 23 may than be formed by stamping them into the desired configuration. Retention clips 22, 27 and 28 are unitary parts of holder 20 but have the sides and top thereof free from contact with any other portion of the holder thus allowing limited rotation of the clips with the lower portion of each clip serving as the axis of rotation for the clip. The bottom portion of clips 22, 27 and 28 may be in alignment on the bottom portions of clips 27 and 28 may begin at outward extension 24*a*. The configuration of clip 22 is best illustrated in FIG. 7. The bottom portion of clip 22 extends vertically upward in the same plane as the card surface and then extends outwardly to form a lip 24 of sufficient depth to accommodate the thickness of card section 14. Clip 22 turns upwardly in a vertical plane 25 for a distance equal to the space between slot 15 and bottom of card section 14 and then turns inwardly on a horizontal plane to form an inwardly extending lip 26 which terminates substantially in alignment with the back surface of card holder 20, as shown in FIG. 6. With minor exceptions, outside retention clips 27 and 28 are formed the same as clip 22 and in the same horizontal plane. Clips 27 and 28 have an outwardly protruding lip 24*a* in the same horizontal plane as lip 24. Clips 27 and 28 then turn upwardly in a vertical plane for a predetermined distance and terminate. Retention clips 27 and 28 are illustrated in FIGS. 5 and 8 and serve, along with clip 22, to secure the card to the holder. Outwardly protruding lips 23 which are optional are formed on the line formed by lip 24, as shown in FIGS. 5 and 6, and serve as card stops.

Figure 9:
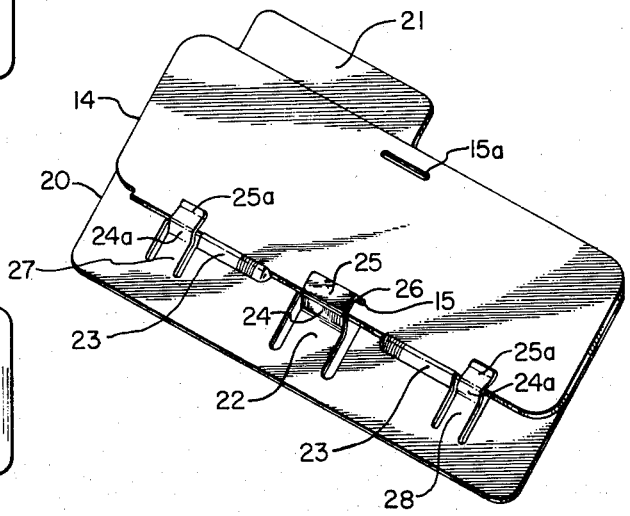

The complete assembly of card section 14 in holder 20 is shown in FIG. 9. The alignment of lips 23, when present, with the lower lips 24 and 24*a* of retention clip 22, 27 and 28 is such that the bottom edge of card section 14 rests thereon when placed in holder 20. Card section 14 is inserted into retention clip 22 by applying pressure on the back side of clip 22, thereby causing the upper portion thereof to rotate outwardly sufficiently far for the portion of card section 14 between slot 15 and the bottom edge of the card to pass under lip 26 and the bottom edge thereof to rest on lips 23, 24 and 24*a* as described. Pressure on retention clip 22 is then released and lip 26 is allowed to protrude through slot 15. The inner surface vertical extension 25 firmly engages the portion of card section 14 between slot 15 and the bottom edge thereof to clamp card section 14 to holder 20. The card is also frictionally held at its outer lower portions by clips 27 and 28 between vertical extensions 25*a* and holder 20.

The upper tab 21 of holder 20 may also contain useful information. For example, an embossed tape of about the same thickness of card section 14 containing the room and/or bed number of a patient to be identified can be adhesively attached thereto.

From the above, it is obvious that the combined card section 14 and the holder 20 when embossed with the desired identification information serves to identify a patient and the room or bed he occupies. This information can readily be transferred to papers, forms, cards, charts, etc., by mechanical means such as is presently done with current patient I.D. cards or commercial credit cards. When a patient is transferred to a different bed or room, card section 14 identifying such patient can be removed from the holder and placed in the appropriate holder identifying the room or bed to which he is moved.

Although a preferred form of my invention has been herein disclosed, it is to be understood that the present disclosure is made by way of example and that variations are possible without departing from the subject matter coming within the scope of the following claims, which subject matter I regard as my invention.

I claim:

1. A duel identification card having a generally rectangular shape and containing:

similarly spaced indentations on either side of said card between the top and bottom thereof;

a score line running from one indentation to the other dividing the card into an upper section and a lower identification section;

a generally vertical notch in the top of said card offset from the horizontal center and extending to and encompassing a portion of said score line dividing the upper section into an upper identification section and a tab section.

2. The identification card as defined in claim 1, wherein the upper identification section is generally rectangular in shape and contains a transverse slot in one end thereof.

3. The identification card as defined in claim 2, wherein the lower identification section contains at least one longitudinal slot centrally located in the lower portion thereof and spaced upwardly from the bottom edge a predetermined distance.

4. The identification card as defined in claim 1, wherein the tab section is in the shape of an irregular quadrangle and the notch is wider at the top than at the bottom.

5. An identification card holder of unitary construction comprising:

a generally flat rectangular spring steel plate having a tab section extending on the top part thereof;

a retention clip centrally located in the lower portion of said plate having freedom of movement at the top and sides but being an integral part of the plate at the bottom, said clip extending upwardly from the bottom in the same plane as the plate, the upper portion of said clip extending, in turn, outwardly, upwardly and then inwardly, terminating in the plane even with the back surface of said plate;

outside retention clips located adjacent to the outside edges of said card holder and in longitudinal alignment with the centrally located clip. Said outside clips extending in turn outwardly and upwardly terminating with the upward extension.

6. The identification card holder as defined in claim 5 wherein said holder has outwardly protruding lips evenly spaced on either side of said centrally located retention clip between said centrally located retention clip and the outside retention clips and in longitudinal alignment with the outward extensions of said retention clips.

7. In combination an identification card and identification card holder comprising:

an identification card having a generally rectangular shape containing a longitudinal slot centrally located in the lower portion thereof and spaced upwardly from the bottom edge a predetermined distance;

a spring steel holder retaining said identification card said holder having:

a. a generally rectangular shape of the same length as the card;

b. a tab section extending from the top part thereof;

c. a retention clip centrally located in the lower portion of said holder having freedom of movement at the top and sides but being an integral part of the holder at the bottom, said clip extending upwardly from the bottom in the same plane as the holder, the upper portion of said clip grasping the card in the area between the transverse slot and the bottom edge thereof, and securing said card against the holder, said clip extending outwardly for a distance equal to the thickness of the identification card, the bottom of the card resting against such outward extension, then upwardly for a distance equal to the distance between the bottom of said card and the longitudinal slot contained therein and then inwardly through said longitudinal slot, and terminating in a plane even with the back surface of said holder;

d. outwardly protruding lips on either side of the centrally located retention clip in the same longitudinal plane as the outward extension of the retention clip against which the bottom of the card rests; and e. outside retention clips located adjacent to the outside edge of each of the outwardly protruding lips and in longitudinal alignment with the centrally located clip; said outside clips being the same as the centrally located clip with the exception that the upper portion of said clips extends outwardly for a distance equal to the thickness of the identification card, the bottom of the card resting against such outward extensions, and then terminating in upward extensions thereby frictionally securing the outer lower portions of the identification card between the holder and said upward extensions, said retention clips being so spaced in said holder that the top edge of the identification card is approximately the same as the top edge of the holder.

* * * * *